US006357552B1

(12) United States Patent
Eitler

(10) Patent No.: US 6,357,552 B1
(45) Date of Patent: Mar. 19, 2002

(54) SUBMERSIBLE PUMP ASSEMBLY FOR DOWNHOLE USE

(75) Inventor: Jörg Eitler, Egglkofen (DE)

(73) Assignee: Netzsch Oilfield Products GmbH, Selb (DE)

( * ) Notice: Subject to any disclaimer, the term of this patent is extended or adjusted under 35 U.S.C. 154(b) by 0 days.

(21) Appl. No.: 09/599,096

(22) Filed: Jun. 19, 2000

Related U.S. Application Data

(63) Continuation of application No. PCT/EP99/08021, filed on Oct. 22, 1999.

(30) Foreign Application Priority Data

Oct. 22, 1998 (DE) ..... 198 48 792

(51) Int. Cl.[7] ..... F01M 1/02
(52) U.S. Cl. ..... 184/6.12; 166/68
(58) Field of Search ..... 184/6.12, 6.4; 475/331; 175/9.5; 166/68, 72

(56) References Cited

U.S. PATENT DOCUMENTS

| | | | | |
|---|---|---|---|---|
| 3,677,665 A | | 7/1972 | Corkill | |
| 3,750,770 A | * | 8/1973 | Botto | 175/173 |
| 3,794,447 A | | 2/1974 | Bullough | |
| 4,854,834 A | * | 8/1989 | Gschwender et al. | 417/423.3 |
| 4,924,698 A | * | 5/1990 | Echert et al. | 73/170 |
| 5,957,222 A | * | 9/1999 | Webb et al. | 175/45 |
| 6,082,470 A | * | 7/2000 | Webb et al. | 175/45 |

FOREIGN PATENT DOCUMENTS

| | | |
|---|---|---|
| DE | 19 13 397 C3 | 9/1970 |
| DE | 35 09 023 C2 | 9/1986 |
| DE | 196 49 422 A1 | 6/1998 |
| DE | 197 15 278 A1 | 12/1998 |

* cited by examiner

*Primary Examiner*—Thomas R. Hannon
*Assistant Examiner*—Chong H. Kim
(74) *Attorney, Agent, or Firm*—Clifford W. Browning; Woodard, Emhardt, Naughton, Moriarty & McNett Patent and Trademark Attorneys

(57) ABSTRACT

A submersible pump assembly comprises a gear transmission (10) and an equalizer (24). The gear transmission (10) includes a transmission housing (12) filled with lubricating fluid in which an input shaft (14, 102, 120) adapted to be driven and an output shaft (16) for driving a pump are supported. A transmission step (22) is provided to reduce the rotational speed of the input shaft (14, 102, 120). The equalizer (24) adapts the lubricating fluid pressure in the transmission housing (12) to ambient pressure. The equalizer (24) is arranged within the transmission housing (12) next to the transmission step (22) so as to distribute the heat generated at the transmission step (22) throughout the lubricating fluid.

11 Claims, 6 Drawing Sheets

SUBMERSIBLE PUMP ASSEMBLY FOR DOWNHOLE USE

Figure 1:
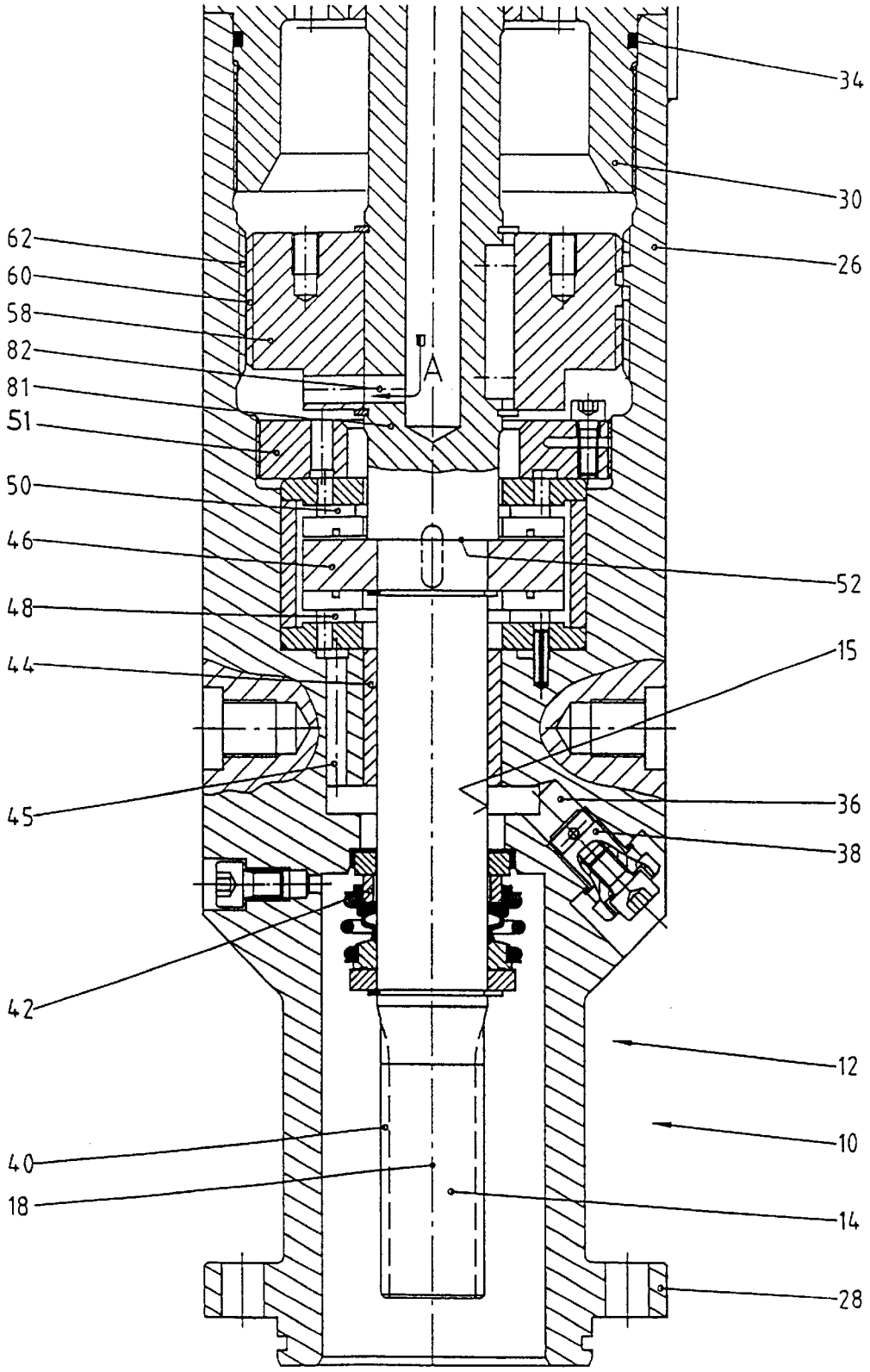

This application is a continuation of PCT/EP99/08021 filed Oct. 22, 1999.

A submersible pump assembly for downhole use. The invention relates to a submersible pump assembly as defined in the preamble of claim 1.

A submersible pump assembly of the generic kind defined is known from U.S. Pat. No. 3,677,665. It comprises a motor, an equalizer, a gear transmission, and a pump, especially an eccentric worm type pump. The motor drives an input shaft of the gear transmission, the output shaft of which drives a rotor of the eccentric worm type pump. The submersible pump assembly is lowered into a well, with the motor disposed at the lower end of the submersible pump assembly, as seen from ground level. The eccentric worm type pump, thus located at the upper end of the submersible pump assembly, conveys into a casing which leads up to ground level. The gear transmission has at least one transmission step in order to step down the rotational speed of the motor to a reduced rotational speed of the pump rotor. This transmission step is cooled and lubricated by a cooling and lubricating fluid. Cooling and lubricating fluids are used also within the eccentric worm type pump or the motor in order to distribute the heat due to energy losses originating in the motor and/or to diminish wear of movable components within the eccentic worm type pump. The equalizer functions to adapt the lubricating fluid pressure to ambient pressure. It is arranged between the gearing and the motor, has its own housing, and is connected in such a way to the gearing and the motor that a pressure balance can be obtained between the lubricating fluids. This does not involve any exchange of lubricating fluid worth mentioning.

The structural units of submersible pump assemblies of the kind defined, such as the motor, the gear transmission, or the pump, each have their own housing of which the diameter is much smaller than the length thereof. The heat due to energy loss has its origin in a limited area, such as the transmission step, for example. Therefore, it is distributed only insufficiently in the elongate housing of the known submersible pump assembly of the kind in question.

It is known from DE 35 09 023 C2 and U.S. Pat. No. 3,794,447 to use a screw thread type pump as the pumping means for conveying lubricating fluids, such a pump comprising at least one conveying thread to generate a flow of fluid in the direction of the axis of rotation of the pump rotor.

A slide ring seal, including a screw thread type pump for the circulation of a cooling, lubricating, or blocking medium is known from DE 19 13 397 C3. It serves to seal a shaft passage aperture in a housing and causes the contact pressure of a slide ring to vary in response to the rotational speed and direction of the shaft to be sealed.

It is the object of the invention to improve a submersible pump assembly of the kind defined such that the heat due to energy loss generated in the pump is distributed more evenly.

The object is met, in accordance with the invention, by the features recited in claim 1.

The provision according to the invention of the equalizer makes it possible for the heat resulting at the transmission step to be distributed directly in the lubricating fluid volume of the equalizer and to be transmitted additionally to the surroundings by the outside surface thereof.

The heat exchange is improved still further by the flow of lubricating fluid generated in the transmission step and in the equalizer, as recited in claim 2.

The provision of two pump means defined in claim 3 produces two lubricating fluid currents of which the individual flow resistance is reduced.

The embodiment according to claim 4 utilizes the centrifugal force which acts during rotation of the shafts on the co-rotating lubricating fluid. That enhances the flow of the lubricating fluid.

The further development described in claim 5 leads to mixing of the lubricating fluid of both flows within the spacing defined, thereby improving the heat exchange.

The further developments presented in claims 6 and 7 result in a particularly compact structure of the submersible pump assembly.

The design according to claim 8 permits the input shaft to be supported between the equalizer and the transmission step, and an exchange of lubricating fluid between the two to take place at the same time.

The arrangement of bearings in accordance with claim 9 provides improved lubrication of the shaft bearings.

An embodiment of the invention will be described in greater detail below with reference to diagrammatic drawings.

FIGS. 1 to 6 illustrate a gear transmission of a submersible pump assembly according to the invention, in vertical sectional elevation, the figures depicting the gear transmission from the lower to the upper ends of an assembly in the well in the order of FIGS. 1 to 6.

The gear transmission 10 comprises a housing 12 which defines an elongate tubular cylinder. An input shaft 14 having a shell surface 15 and an output shaft 16 having a shell surface 17 are supported in the housing 12. The input shaft 14 is driven by a motor (not shown) disposed at the lower end of the gear transmission 10. The output shaft 16 drives a pump (not shown), especially an eccentric worm type pump which is disposed at the upper end of the gear transmission 10. The axis 18 of the input shaft 14 is aligned with the axis 20 of the output shaft 16. A two-step in-line planetary gearing 22 is arranged between the two shafts 14 and 16 so as to reduce the rotational speed of the input shaft 14 driven by the motor to a rotational speed of the output shaft 16, as required for the pump.

The housing 12 is filled substantially with a lubricating fluid which serves both to lubricate elements subject to wear and to dissipate and distribute frictional heat. In view of the fact that the ambient pressure in a well may be much higher than the pressure above ground surface, possibly reaching as much as 70 bar, and further in view of the fact that the lubricating fluid expands by heating inside the housing, there must be a possibility to balance the pressure between the lubricating fluid and the surroundings. To accomplish that, the gear transmission 10 comprises an equalizer 24 disposed next to the two-step in-line planetary gearing 22 in the direction toward the lower end of the gear transmission 10. The equalizer 24 is integrated in the housing 12 of the gear transmission 10.

FIG. 1 illustrates a first housing section 26 of the housing 12, including a flange 28 which projects radially from the periphery at the lower end. The flange 28 is provided for fastening of a motor or a motor equalizer. The first housing section 26 is followed by a second housing section 30 which is threaded into the first housing section 26. The housing sections 26 and 30 are sealed with respect to each other by a sealing ring 34, further housing sections are sealed in analogous fashion. The first housing section 26 is formed with a threaded filling bore 36 which is inclined with respect to the longitudinal axis of the housing section and into which a filling valve 38 is threaded to permit the housing 12 to be supplied with the lubricating fluid. The filling is done on the ground prior to installation in the well and from below, thus displacing and forcing out in upward direction any air trapped in the gear transmission 12.

The input shaft 14 is provided in its lower end region with a multi-groove profile 40 for coupling to the motor or motor equalizer. The multi-groove profile 40 is followed by a simple slide ring seal 42 which establishes sealing between the input shaft 14 and the first housing section 26. Next to the slide ring seal 42 a radial friction bearing 44 is supported at the first housing section 26 to guide the input shaft 14. At least one axial bore 45 extends in parallel with the radial friction bearing 44 in the first housing section 26. In axial direction, the radial bearing 44 is followed by a pressure disc 46 axially fixed on the input shaft 14. In downward direction, the axial disc 46 is supported axially by a slide shoe 48, thus resting on the first housing section 26, and in upward direction by a slide shoe 50, thus resting on a locking nut 51 which is threaded into the first housing section 26. The axial pressure disc 46 engages a step 52 formed in the input shaft 14 and thus acts as an axial bearing for the input shaft 14.

Figure 2:
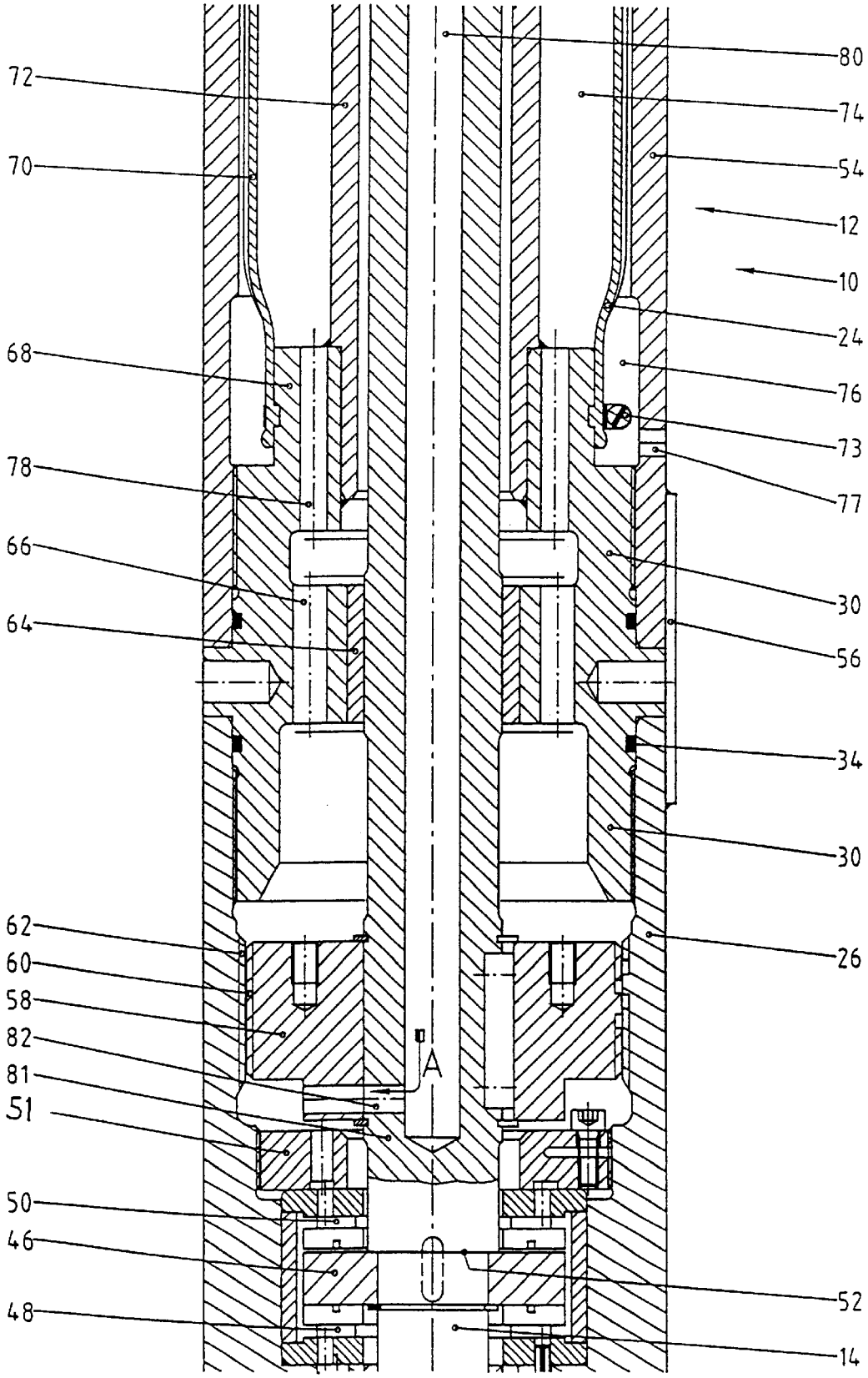

The upper part of the first housing section 26 is to be seen at the bottom of FIG. 2. It is followed by the second housing section 30 and a third housing section 54 into which the second housing section 30 is threaded in a manner corresponding to its threading into the first housing section 26. These threaded connections are secured against separation by thin walled webs 56 welded to the various housing sections 26, 30 and 54. The input shaft 14 passes through the second housing section 30, the third housing section 54, and a fourth housing section 84 illustrated in FIGS. 3 and 4.

A pump disc 58, provided at its circumference with a conveying thread 60 which rotates when in operation, is slipped in axial direction and axially fixed on the input shaft 14 next to the axial pressure disc 46. At the side opposite the rotating conveying thread 60, the first housing section 26 is formed with a stationary conveying thread 62 oriented in opposite direction to the rotating conveyor thread 60. Together the two conveyor threads 60 and 62 form a screw thread type pump to set the lubricating fluid into circulation.

Next to the pump disc 58, a radial bearing 64 is mounted on the input shaft 14 and supported on the second housing section 30. The second housing section 30 is formed with at least one bore 66 in parallel with the radial bearing 64 through which bore lubricating fluid may flow in axial direction. The second housing section 30 includes not only the radial bearing 64 but also a connector ring 68 on the outer circumference of which an equalizer hose 70 is slipped and on the inner circumference of which a support tube 72 is supported both radially and axially.

The equalizer hose 70 is secured by a clamping ring 73 so as to be sealed on the periphery of the connector ring 68, and it extends parallel to the wall of the third housing section 54. The equalizer hose defines an interior space 74 and an exterior space 76, the latter being located between the equalizer hose 70 and the third housing section 54. The exterior space 76 communicates with the surroundings through an opening 77. At least one bore 78 extends through the connector ring 68, presenting a connection for liquid passage between the bore 66 and the interior space 74.

The input shaft 14 is formed with an axial bore 80 extending from the upper end of the input shaft 14 to behind the pump disc 58. Between the pump disc 58 and the axial pressure disc 46 a radial bore 82 is formed in the lower end region 81 of the input shaft 14; it extends through the pump disc 58 as well and establishes a connection for liquid passage between the axial bore 80 and the conveying threads 60 and 62.

Figure 3:
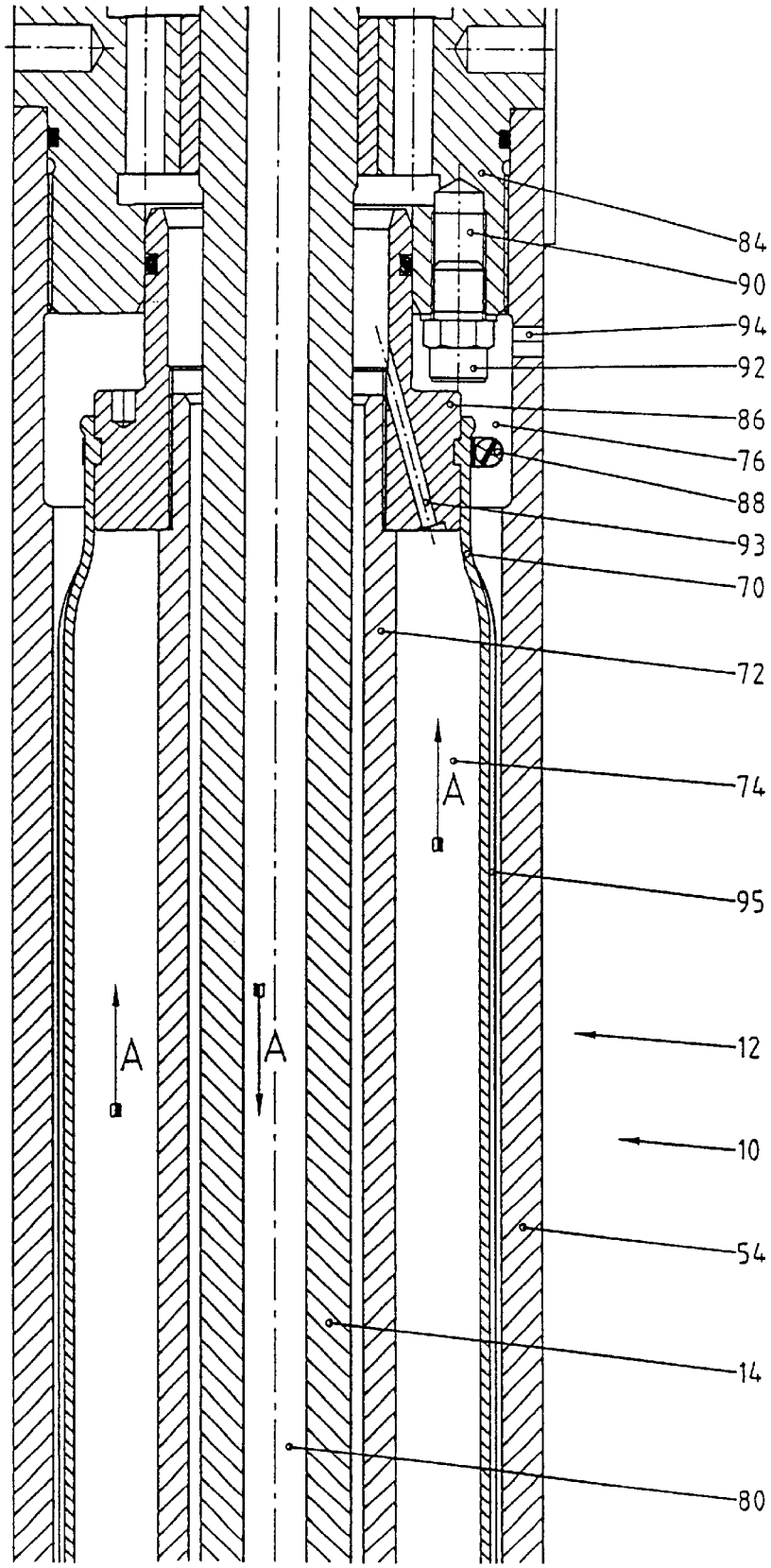

FIG. 3 depicts the continuation of the third housing section 54, the equalizer hose 70, the interior space 74, the supporting tube 72, and the input shaft 14 with its axial bore 80. The fourth housing section 84, already mentioned, is screwed into the third housing section 54. A connector ring 86 is fixed in the fourth housing section 84, and the equalizer hose 70 is slipped on the upper end region of the same where it is sealingly secured by a clamping ring 88. The support tube 72 rests axially and radially on the connector ring 86. In the fourth housing section 84, a check valve 92 is screwed into an axially directed threaded bore 90. At least one inclined bore 93 extends through the connector ring 86, establishing a connection for liquid passage between the interior space 74 and the threaded bore 90. When open, the check valve 92 connects the interior space 74 to the exterior space 76. Another opening 94 extends through the third housing section 54, presenting another connection for liquid passage between the surroundings and the exterior space 76.

The interior space 74 is filled substantially with lubricating fluid. The lubricating fluid expands during operation of the gear transmission, thereby widening the equalizer hose 70 up to a maximum permissible volume. When that is reached, the equalizer hose 70, being equipped with external fins 95, engages the inside shell surface of the third housing section 54 with its fins. When the maximum permissible volume is reached, the pressure in the interior space 74 will have attained such a level that the check valve 92 opens to let lubricating fluid from the interior space 74 escape into the exterior space 76. The check valve 92 opens at a defined differential pressure so that excess pressure will prevail in the interior space 74 as compared to the exterior space 76 and the surroundings.

Upon shut-off of the gear transmission 10, the lubricating fluid in the interior space 74 will cool down and, therefore, contract. As the exterior space 76 is connected to the surroundings through the openings 77 and 94 in a way permitting liquid communication, ambient pressure prevails in the exterior space 76, compressing the equalizer hose 70. The pressure comes to be balanced between the surroundings and the interior space 74. The supporting tube 72 keeps the equalizer hose 70 spaced from the input shaft 14 in order to prevent it from being damaged upon renewed start-up of the input shaft 14. The dimension of the equalizer hose 70 is selected such that it can compensate the expansion in volume of the lubricating fluid upon heating. The length of the equalizer hose 70, for example, is approximately 480 mm and its inner diameter at the connector ring 68, 86 is approximately 90 mm.

Figure 4:
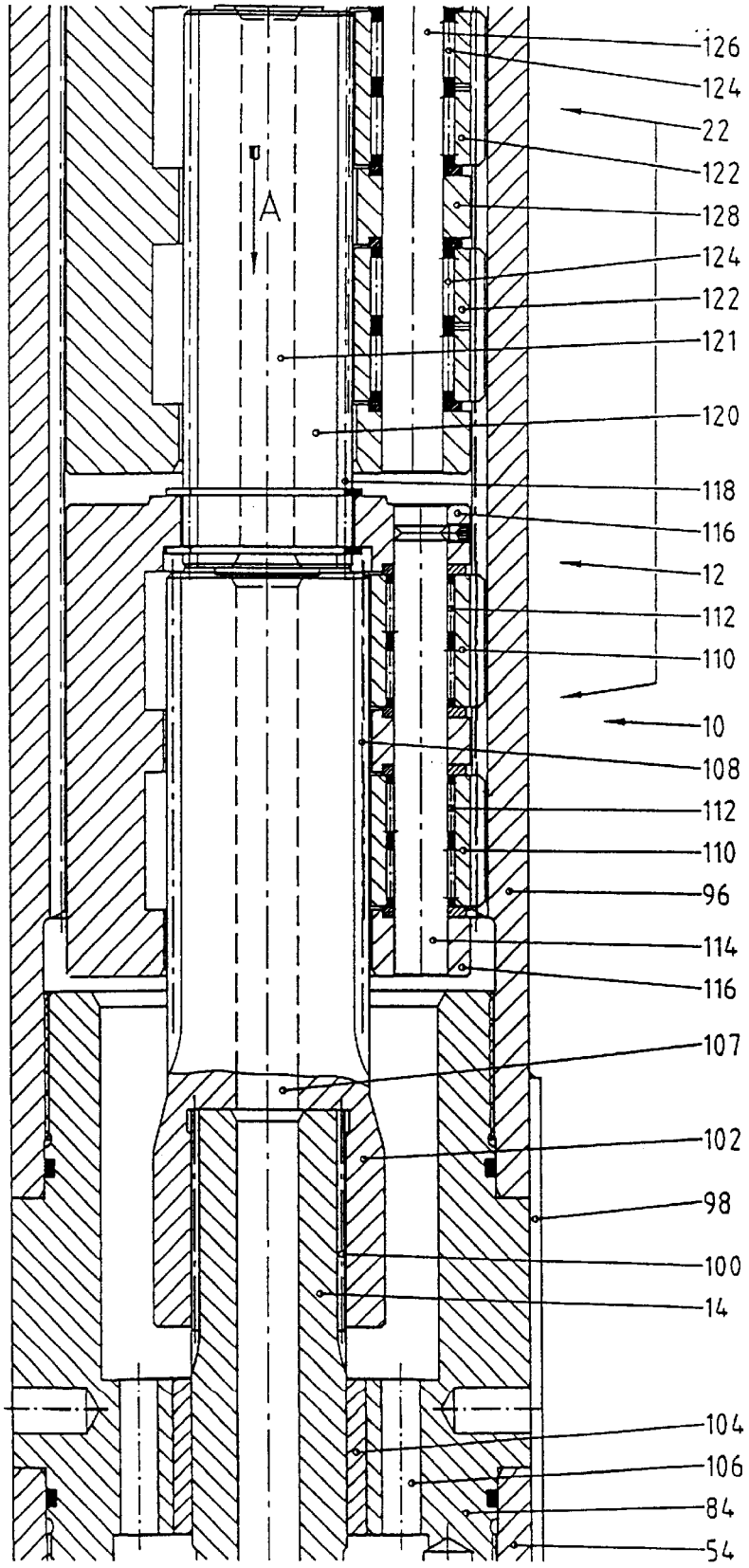

The upper end region of the fourth housing section 84 and of the input shaft 14 is shown at the bottom in FIG. 4. The fourth housing section 84 is screwed into a fifth housing section 96. The threaded connections between the fourth housing section 84 and the third and fifth housing sections 54 and 96, respectively, are secured against unintentional separation by thin walled webs 98 welded to the outside. A radial friction bearing 104 supported on the fourth housing section 84 is disposed in the upper end region of the input shaft 14. At least one axial bore 106 is provided in the fourth housing section 84, forming a flow passage in parallel with the radial friction bearing 104. Next to the radial friction bearing, the input shaft 14 is formed with a multi-groove profile 100 on which is donned a corresponding multi-groove hub profile of an intermediate shaft 102. It is likewise possible for the intermediate shaft 102 to be integral with the input shaft.

The intermediate shaft 102 is supported axially in downward direction on the input shaft 14, and an axial bore 107 extends through the intermediate shaft. In its upper region it comprises a spur gear 108 functioning as the sun gear of a first planetary gear step. Planet pinion pairs 110 arranged in parallel and supported by double-row needle bearings 112 on a planet shaft 114 mesh with the spur gear 108. The planet shaft 114 is secured in a planet pinion carrier 116 which is axially fixed by a spur gear 118 for joint rotation with a gear shaft 120 designed, in this case, as the sun gear shaft. The gear shaft 120 has an axial bore 121 extending through it and is supported downwardly on the intermediate shaft 102. Planet pinion pairs 122 arranged in parallel and supported by double-row needle bearings 124 on a planet shaft 126 mesh with the spur gear 118. The planet shaft 126 is secured in a planet pinion carrier 128.

Figure 5:
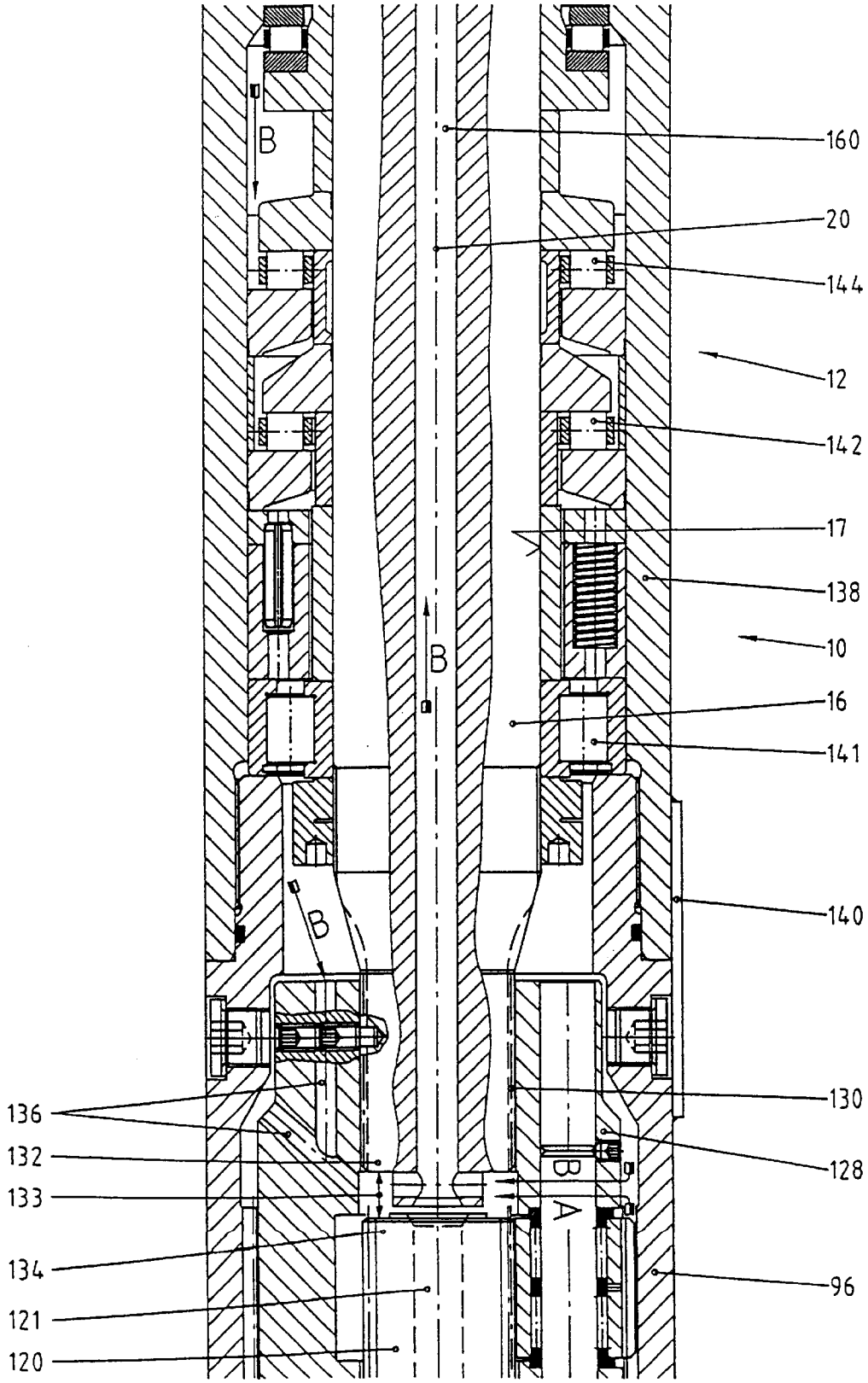

The upper end of the fifth housing section 96 and of the planet pinion carrier 128 is illustrated at the bottom in FIG. 5. The planet pinion carrier 128 has internal radial teeth 130 into which corresponding external radial teeth at the lower end of the output shaft 16 are inserted. The output shaft 16 is supported by axial bearings, described in greater detail below, such that its lower end 132 is retained at a spacing 133 from the upper end 134 of the gear shaft 120. The design of this separation of the output shaft 16 from the other shafts 120, 102, 14 is optional and may be provided either as shown or between the sun gear shaft 120 and the intermediate shaft 102. In this area, the planet pinion carrier 128 has an axial opening 136 so that lubricating fluid can flow from the planet pinion pairs 122 in FIG. 4 through the opening 136 to the bores 121, 107 in FIG. 4 and on into the bore 80 in FIG. 3.

Figure 6:
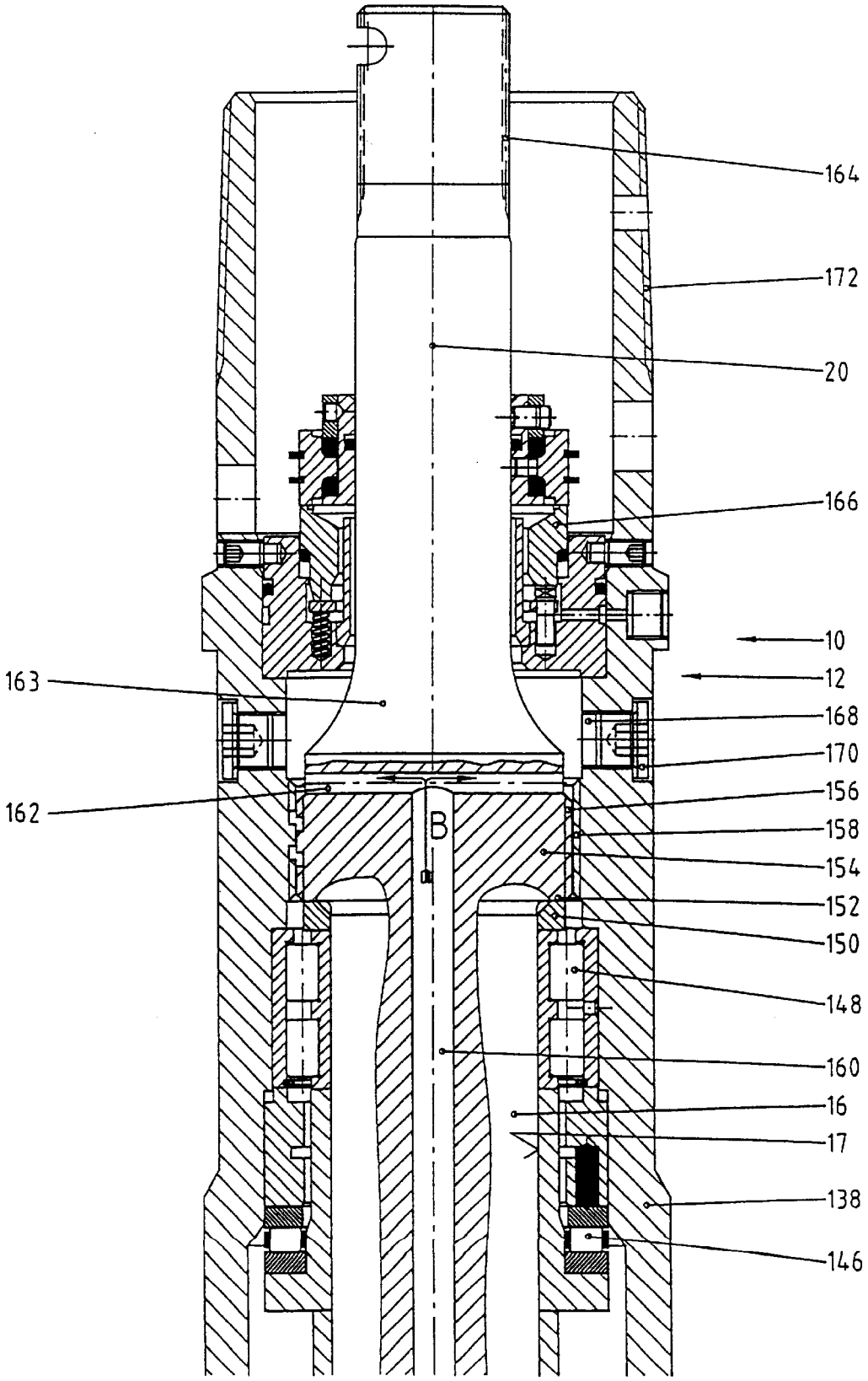

The fifth housing section 96 is threaded into a sixth housing section 138. This screw connection likewise is secured against separation by thin-walled webs 140 attached by welding. A radial roller bearing 141 of N-type structure and, next to it, two axial roller bearings 142, 144 are mounted on the output shaft 16, from the bottom to the top as seen in FIG. 5, thus providing downward support to the output shaft 16. FIG. 6 shows the upper end regions of the sixth housing section 138 and the output shaft 16. The axial roller bearing 144 to be seen in FIG. 5 is followed by an axial roller bearing 146 which supports the output shaft 16 upwardly in axial direction. Next to the axial roller bearing 146 there is a double-row radial roller bearing 148, likewise of N-type structure according to DIN 5412. Its inner shell is supported through an intermediate ring 150 on a step 152 presented by the output shaft 16, thereby serving as support for the axial roller bearings 142, 144, and 146 so that the output shaft 16 is supported axially downwardly, as described.

Apart from the step 152, the output shaft 16 is formed with a shaft collar 154 which has a conveying thread 156 at its circumference. In this area, the inner circumference of the sixth housing section 138 is formed with a conveying thread 158 which is directed in opposite sense to the conveying thread 156. An axial bore 160 extends through the output shaft 16 from the lower end 132 thereof in FIG. 5 to beyond the shaft collar 154. In the upper end region 163 of the output shaft 16 at least one radial bore 162 provides a connection for the passage of liquid between the axial bore 160 and the conveying thread 156.

In its upper end region 163, the output shaft 16 is formed with a multi-groove profile 164 for coupling to a pump (not shown). Below the multi-groove profile 164, a single slide ring seal 166 is fixed on the output shaft 16 to seal the output shaft 16 with respect to the sixth housing section 138. A threaded bore 168 extends through the wall of the sixth housing section 138 below the single slide ring seal 166 and a plug 170 is threaded into this bore. The plug 170 may be removed from the threaded bore 168 for venting of the gear transmission 10 during filling or for aeration while the lubricating fluid is drained from it. The sixth housing section 138 comprises a thread 172 in its upper end region to which the pump housing can be attached.

In operation of the gear transmission 10, rotation of the conveying threads 60 and 156 causes the conveying threads 60, 62, 156, and 158 to transport lubricating fluid from the outer end regions of the housing 12 towards the middle. In this manner two fluid flows A and B are generated, as indicated by arrows in the figures.

Fluid flow A flows from the pump disc 58 along the shell surface of the input shaft 14 through the bores 66 and 78 into the interior space 74. In the interior space 74 the lubricating fluid, in addition, can give off heat across the entire surface of the equalizer hose 70 and this heat will then be absorbed by ambient liquid in the exterior space 76. When the equalizer hose 70 engages the inside of the third housing section 54 because the lubricating fluid is particularly hot and therefore greatly expanded, direct heat conduction becomes possible from the lubricating fluid through the equalizer hose 70 and the wall of the third housing section 54 to the surroundings. In this way the dissipation of heat is particularly good.

From the interior space 74 and through the bores 93 and 106 the lubricating fluid continues to flow axially along the planet pinion pairs 110 and 122, passing around the two-step in-line planetary gearing 22 and taking up the friction heat generated there. Passing through opening 136, the fluid flow A gets inwards into the bores 121, 107, and 80. The lubricating fluid flows back axially towards the radial bore 82 and passes through the same in outward direction to the conveying threads 60 and 62, especially due to centrifugal force prevailing during rotation. The fluid flow A thus forms a closed circuit in which the heat generated at the two-step in-line planetary gearing 22 is absorbed and then given off again over the full length of the housing 12 and, in addition, at the equalizer 24.

Fluid flow B is generated during operation by the conveying threads 156 and 158. It flows along the shell surface 17 of the output shaft 16 through the radial roller bearing 148, the axial roller bearings 142, 144, and the radial roller bearing 140. The lubricating fluid of fluid flow B passes inwardly through the opening 136 and the spacing 133 to the axial bore 160. In doing so, it mixes with the lubricating fluid of fluid flow A. Axial bore 160 guides the fluid flow B axially upwardly to the radial bore 162 through which it passes outwardly, in particular due to the centrifugal force, thus reaching the conveying threads 156 and 158. Fluid flow B leads to improved lubrication of the bearings of the output shaft 16. Additionally, it absorbs heat from fluid flow A and distributes it in the upper region of the gear transmission 10, whereby improved heat exchange over the entire outside surface of the housing 12 is warranted.

What is claimed is:

1. A submersible pump assembly for downhole use, comprising a gear transmission (10) which comprises a transmission housing (12) filled with lubricating fluid, an input shaft (14) adapted to be driven, at least one transmission step (22) to reduce the rotational speed of the input shaft (14, 102, 120), an output shaft (16) for driving a pump, and at least one equalizer (24) for adaptation of the lubricating fluid pressure in the transmission housing (12) to ambient pressure, wherein the equalizer (24) is arranged within the transmission housing (12) next to the transmission step (22) and incorporated in a lubricating fluid circuit and at least one pump means (60, 62; 156, 158) causes the lubricating fluid in the transmission step (22) and in the equalizer (24) to flow in axial direction of the transmission step (22), a first pump means (60, 62) and a second pump means (156, 158) each are arranged in axially outer end regions (81, 163) of the input (14) and output (16) shafts, respectively, to each convey the lubricating fluid axially inwardly towards the middle so that two opposed flows (A, B) will result.

2. The submersible pump assembly as claimed in claim 1, wherein the input (14) and output (16) shafts are aligned and include longitudinal conduits (80, 107, 121, 160) at least between the first (60, 62) and second pump means (156, 158) as well as a first transverse conduit (82) and a second transverse conduit (162) outside of the first (60, 62) and second pump means (156, 158), respectively, so that lubricating fluid can flow from the longitudinal conduits (80, 107, 121, 160) in radial direction to shaft surfaces (15, 17).

3. The submersible pump assembly as claimed in claim 2, wherein the input (14) and output (16) shafts define at least one spacing (133) in axial direction between the first (60, 62) and second pump means (156, 158) through which spacing lubricating fluid can flow in radial direction from the shaft surfaces (15, 17) to the longitudinal conduits (80, 107, 121, 160).

4. The submersible pump assembly as claimed in any one of claims 1 to 3, wherein the pump means (60, 62; 156, 158) are disposed on the input (14) and output (16) shafts, respectively, and each comprise at least one conveying thread (60, 62; 156, 158).

5. The submersible pump assembly as claimed in claim 4, wherein the pump means (60, 62; 156, 158) comprise a rotating conveying thread (60, 156) and a stationery conveying thread (62, 158) oriented in opposite direction (screw thread type pumps).

6. The submersible pump assembly as claimed in claim 1, wherein an antifriction bearing (104) having at least one axial flow passage (106) is arranged on the input shaft (14) between the equalizer (24) and the transmission step (22).

7. The submersible pump assembly as claimed in claim 1, wherein at least one antifriction bearing (140, 142, 144, 146, 148) is provided through which lubricating fluid can flow in axial direction.

8. The submersible pump assembly as claimed in claim 1, wherein an antifriction bearing (44, 64) having at least one axial flow passage (45, 66) is arranged on the output shaft (16).

9. A submersible pump assembly for downhole use, comprising a gear transmission (10) which comprises a transmission housing (12) filled with lubricating fluid, an input shaft (14) adapted to be driven, at least one transmission step (22) to reduce the rotational speed of the input shaft (14, 102, 120), an output shaft (16) for driving a pump, and at least one equalizer (24) for adaptation of the lubricating fluid pressure in the transmission housing (12) to ambient pressure, wherein the equalizer (24) is arranged within the transmission housing (12) next to the transmission step (22) and incorporated in a lubricating fluid circuit and at least one pump means (60, 62; 156, 158) causes the lubricating fluid in the transmission step (22) and in the equalizer (24) to flow in axial direction of the transmission step (22), the input shaft (14) having a connecting portion (40) which is adapted to be connected to driving means for driving the input shaft (14) in rotation, a sealing means (42) being arranged between the transmission housing (12) and the input shaft (14) such as to separate said lubricating circuit from said connecting portion (40) and, thus, from said driving means.

10. The submersible pump assembly as claimed in claim 9, wherein a first pump means (60, 62) and a second pump means (156, 158) each are arranged in axially outer end regions (81, 163) of the input (14) and output (16) shafts, respectively, to each convey the lubricating fluid axially inwardly towards the middle so that two opposed flows (A, B) will result.

11. The submersible pump assembly as claimed in claim 10, wherein the input (14) and output (16) shafts are aligned and include longitudinal conduits (80, 107, 121, 160) at least between the first (60, 62) and second pump means (156, 158) as well as a first transverse conduit (82) and a second transverse conduit (162) outside of the first (60, 62) and second pump means (156, 158), respectively, so that lubricating fluid can flow from the longitudinal conduits (80, 107, 121, 160) in radial direction to shaft surfaces (15, 17).

* * * * *